US010288275B2

(12) United States Patent
Kim et al.

(10) Patent No.: US 10,288,275 B2
(45) Date of Patent: May 14, 2019

(54) LED LIGHTING FIXTURE

(71) Applicant: SAEBIT TECH INC., Gwangmyeong-si, Gyeonggi-do (KR)

(72) Inventors: Gi Woo Kim, Bucheon-si (KR); Sang Min Park, Anyang-si (KR)

(73) Assignee: SAEBIT TECH INC., Gwangmyeong-si, Gyeonggi-do (KR)

( * ) Notice: Subject to any disclaimer, the term of this patent is extended or adjusted under 35 U.S.C. 154(b) by 0 days.

(21) Appl. No.: 15/751,880

(22) PCT Filed: Aug. 17, 2016

(86) PCT No.: PCT/KR2016/009051
§ 371 (c)(1),
(2) Date: Mar. 14, 2018

(87) PCT Pub. No.: WO2017/030374
PCT Pub. Date: Feb. 23, 2017

(65) Prior Publication Data

US 2018/0231230 A1 Aug. 16, 2018

(30) Foreign Application Priority Data

Aug. 18, 2015 (KR) ..... 10-2015-0116309

(51) Int. Cl.
*F21V 29/71* (2015.01)
*H05B 37/02* (2006.01)
(Continued)

(52) U.S. Cl.
CPC ..... *F21V 29/713* (2015.01); *F21V 15/01* (2013.01); *F21V 23/02* (2013.01); *F21V 29/51* (2015.01);
(Continued)

(58) Field of Classification Search
CPC ..... F21V 29/713; F21V 29/51; F21V 29/70; F21V 29/71; F21V 29/74; F21V 29/77;
(Continued)

(56) References Cited

U.S. PATENT DOCUMENTS

2009/0040760 A1* 2/2009 Chen ..... F21V 29/004 362/249.01
2009/0097241 A1* 4/2009 Xu ..... F21K 9/00 362/234
(Continued)

FOREIGN PATENT DOCUMENTS

KR 10-2007-0039777 A 4/2007
KR 10-2010-0055320 A 5/2010
(Continued)

OTHER PUBLICATIONS

International Search Report for PCT/KR2016/009051 dated Nov. 11, 2016 from Korean Intellectual Property Office.

*Primary Examiner* — Anabel Ton
(74) *Attorney, Agent, or Firm* — Revolution IP, PLLC

(57) ABSTRACT

An LED lighting fixture includes: an LED unit which emits light; a control board in which a plurality of LED units are arranged and which supplies power to the LED unit; a heat dissipation unit which is coupled to the control board so as to transmit heat generated from the control board; a cooling unit coupled to the heat dissipation unit for cooling the heat dissipation unit by non-powered circulation of an embedded actuating fluid; and a hollow illumination body unit which embeds the heat dissipation unit and the cooling unit therein and supports the heat dissipation unit so as to have the LED unit exposed.

11 Claims, 5 Drawing Sheets

(51) Int. Cl.

| | |
|---|---|
| ***F21V 29/51*** | (2015.01) |
| ***F21V 29/77*** | (2015.01) |
| ***F21V 15/01*** | (2006.01) |
| ***F21V 23/02*** | (2006.01) |
| ***F21V 31/00*** | (2006.01) |
| ***F21V 29/83*** | (2015.01) |
| *F21Y 105/10* | (2016.01) |
| *F21Y 115/10* | (2016.01) |

(52) U.S. Cl.
CPC ..... *F21V 29/77* (2015.01); *F21V 29/83* (2015.01); *F21V 31/005* (2013.01); *H05B 37/02* (2013.01); *F21Y 2105/10* (2016.08); *F21Y 2115/10* (2016.08)

(58) Field of Classification Search
CPC ..... F21V 17/10; F21V 23/02; F21V 31/005; F21K 99/00; F21S 2/00
See application file for complete search history.

(56) References Cited

U.S. PATENT DOCUMENTS

| | | | | |
|---|---|---|---|---|
| 2009/0236626 | A1* | 9/2009 | Xiao | F21V 29/004 257/99 |
| 2009/0237929 | A1* | 9/2009 | Kuo | F21S 8/08 362/235 |
| 2011/0317420 | A1* | 12/2011 | Jeon | F21S 2/005 362/249.02 |
| 2013/0229806 | A1 | 9/2013 | Choi | |

FOREIGN PATENT DOCUMENTS

| | | | |
|---|---|---|---|
| KR | 10-1031650 | B1 | 4/2011 |
| KR | 10-2011-0119234 | A | 11/2011 |
| KR | 20-0460223 | Y1 | 5/2012 |
| KR | 10-2012-0080871 | A | 7/2012 |
| KR | 10-1333009 | B1 | 11/2013 |
| KR | 10-2014-0051699 | A | 5/2014 |

* cited by examiner

【Fig. 1】
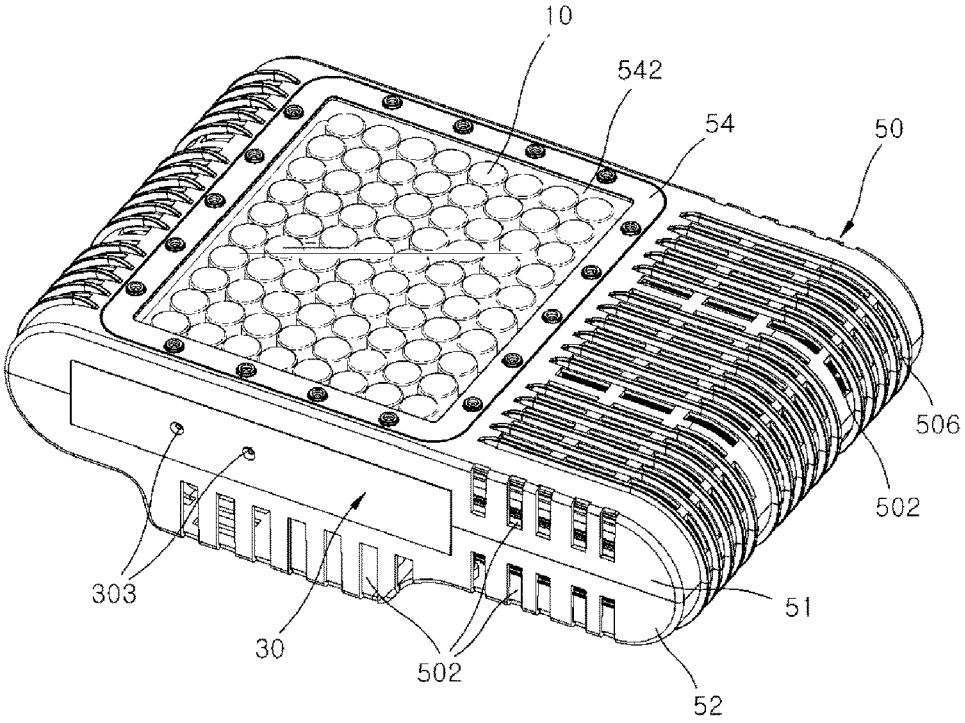
【Fig. 2】
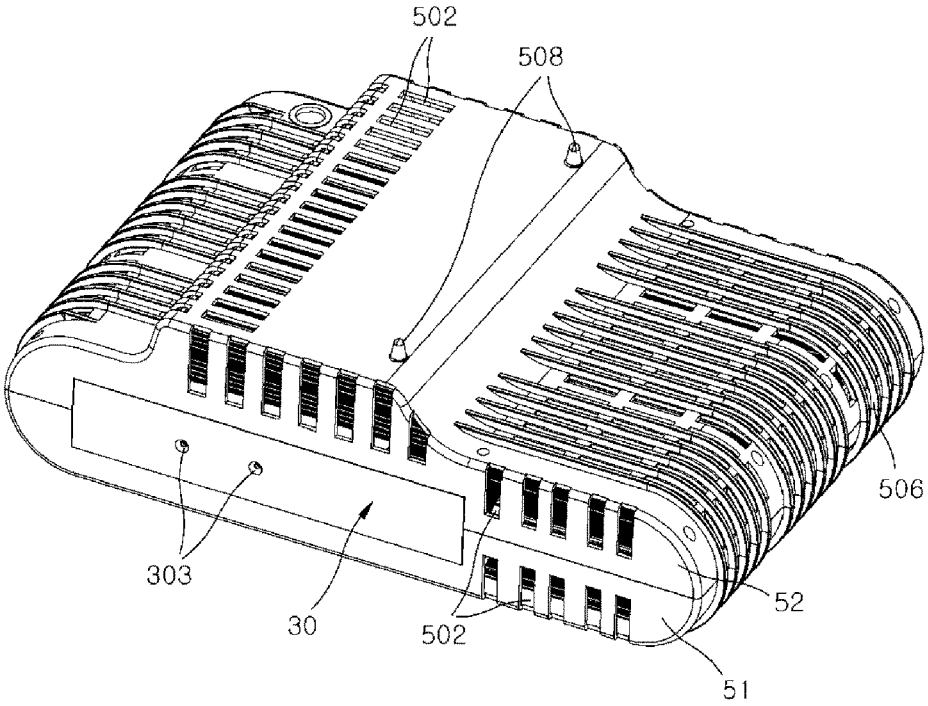

【Fig. 3】
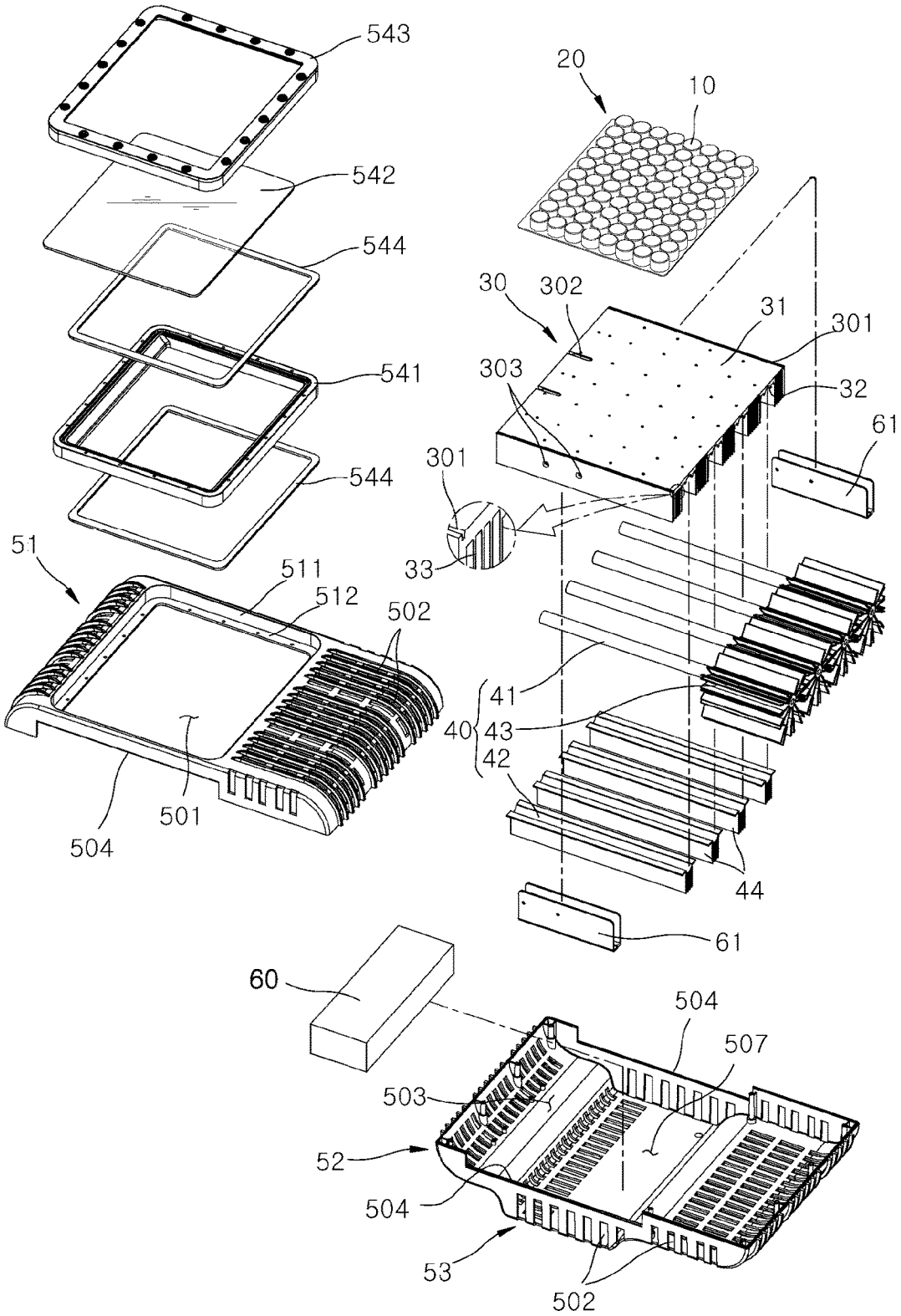

【Fig. 4】
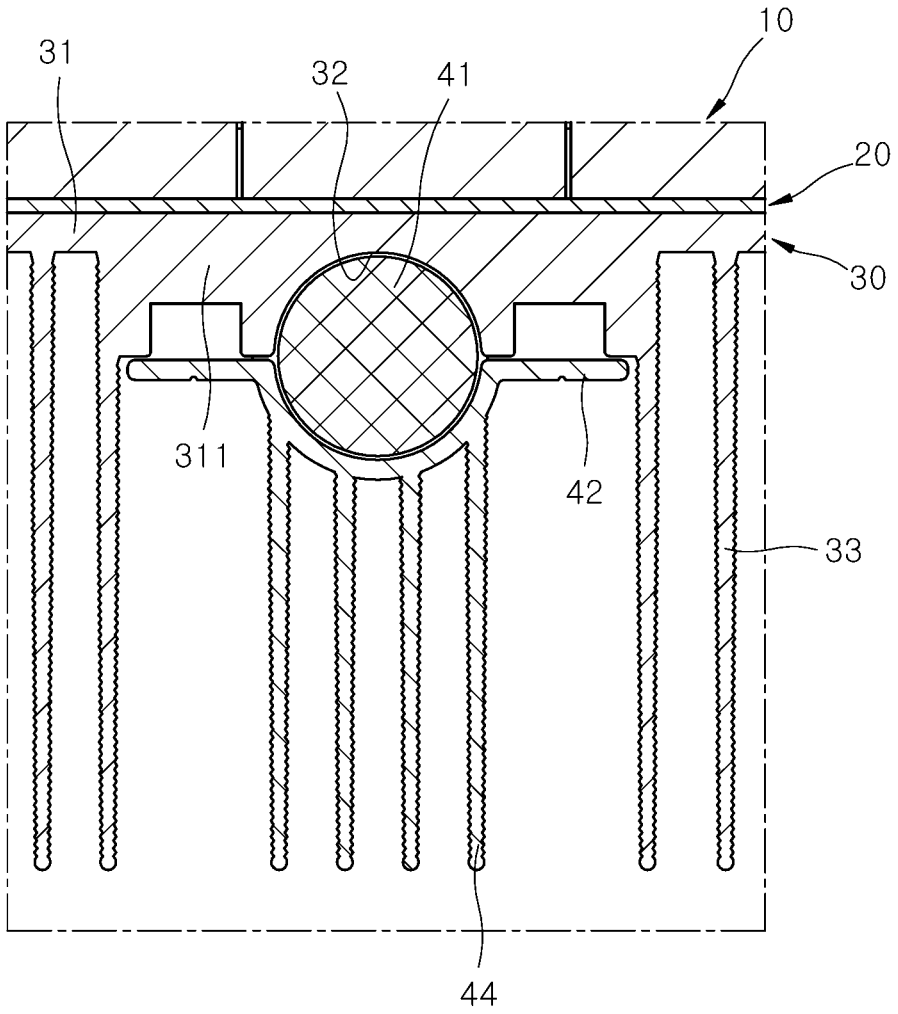

【Fig. 5】
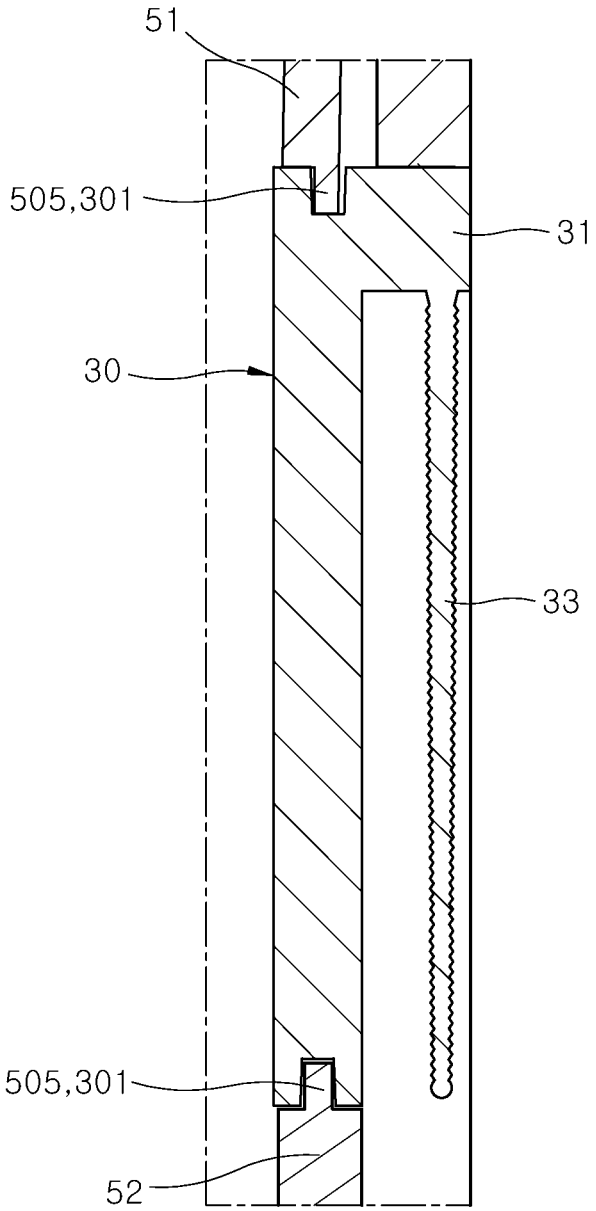

【Fig. 6】
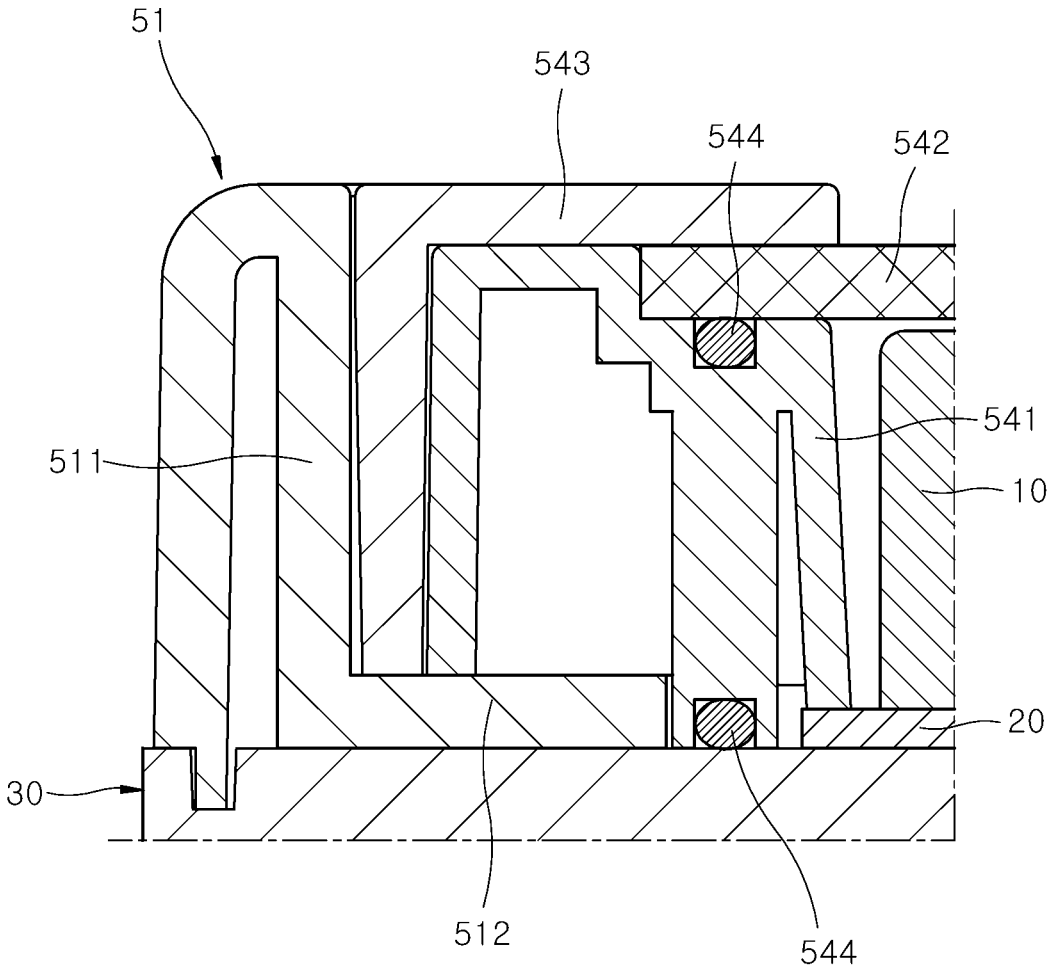

LED LIGHTING FIXTURE

TECHNICAL FIELD

The present invention relates to an LED lighting fixture, and more particularly to an LED lighting fixture in which power of LED units is increased even though the number of LED units arranged on a control board is decreased, an effect on dissipating heat from the LED units is enhanced, and a visible range of a lighting fixture is increased with improved straight propagation of light emitted from the lighting fixture.

BACKGROUND ART

In general, an incandescent lamp or a fluorescent lamp has been mainly used for indoor or outdoor lighting. Such an incandescent lamp or a fluorescent lamp has a problem that its life is short and there is a need of frequent replacement. To solve this problem, there has been developed a lighting fixture that employs an LED excellent in controllability, quick response speed, high photoelectric transformation efficiency, long life, low power consumption, and high brightness.

In other words, a light emitting diode (LED) has advantages of consuming less power with the high photoelectric transformation efficiency, requiring no preheating time because the light emission is not based on heat and electric discharge, and being quickly turned on and off.

Further, advantageously, the LED is strong on a shock and safe because there are no needs of gas or filaments, consumes less power because stable direct-current (DC) lighting method is employed, operates at high repetitions and pulses, reduces fatigue of optic nerves, is usable semi-permanently, has lighting effects with various colors, and is miniaturized using small light sources.

However, the LED generates more heat as its power increases, and it is thus important to dissipate heat. In the case where the power of the LED is lowered to generate less heat, more LEDs are needed to reach desired power, thereby causing a problem of increasing the volume and weight of the LED lighting fixture. In particular, when the volume and weight of the LED lighting fixture are increased, there are difficulties in installation and maintenance.

Further, when the LED is applied to a visible ray searchlight or an infrared surveillance camera, efficiency in straight propagation of light is important. In this case, when the power of the LED is lowered, the straight propagation of light is deteriorated and a visible range is decreased.

As the prior art literatures, Korean Patent No. 10-1333009 (tilted 'LED LIGHTING APPARATUS FOR ANTI-GLARE,' published on Nov. 27, 2013).

DISCLOSURE

Technical Problem

The object of the present invention is conceived to solve the conventional problems, and achieved by providing an LED lighting fixture in which power of LED units is increased even though the number of LED units arranged on a control board is decreased, an effect on dissipating heat from the LED units is enhanced, and a visible range of a lighting fixture is increased with improved straight propagation of light emitted from the lighting fixture.

Technical Solution

According to a preferred embodiment for achieving the foregoing object of the present invention, an LED lighting fixture includes an LED unit which emits light; a control board on which a plurality of LED units is arranged and which applies electric power to the LED units; a heat dissipation unit which couples with the control board so that heat generated in the control board can be transferred thereto; a cooling unit which is coupled to the heat dissipation unit and cools the heat dissipation unit by non-powered circulation of an actuating fluid filled therein; and a hollow illumination body unit which is internally provided with the heat dissipation unit and the cooling unit and supports the heat dissipation unit while exposing the LED unit.

Here, the heat dissipation unit includes a heat dissipation plate with which the control board is in close contact; a plurality of mounting slit grooves which are provided in the heat dissipation plate and spaced apart from each other to mount the cooling unit thereto; and a plurality of heat dissipation fins which protrude from the heat dissipation plate, and the cooling unit includes a heat pipe which is filled with the actuating fluid, and is in close contact with and supported by the mounting slit groove so as to partially protrude from one side of the heat dissipation plate; a mounting holder which mounts the heat pipe to the heat dissipation plate; and a plurality of cooling fins which protrude from a part of the heat pipe protruding from one side of the heat dissipation plate.

Here, the illumination body unit includes a plurality of ventilation holes through which air passes, and a guide projection protruding from one side of the ventilation hole.

Here, the illumination body unit includes a circulation activator which makes the heat pipe be relatively elevated at a side of the cooling fin.

Here, the mounting slit groove is recessed on a heat dissipation block protruding from the heat dissipation plate.

The LED lighting fixture according to the present invention further includes a power control unit which controls electric power applied to the control board.

Here, the illumination body unit includes a front body which includes a through hole for exposing the LED unit and a plurality of ventilation holes for passing air, and is supported on the heat dissipation unit; a rear body which includes the ventilation hole, is supported on the heat dissipation unit, and couples with the front body; an accommodating space which is formed in at least one of the front body and the rear body to accommodate the heat dissipation unit and the cooling unit; and a transmission cover which opens and closes the through hole.

Here, the heat dissipation unit is formed with a support groove recessed thereon, and the front body and the rear body are respectively formed with support protrusions protruding therefrom to be inserted in the support groove.

Here, at least one of the front body and the rear body includes an exposure groove in which the heat dissipation unit is inserted and supported, and the exposure groove includes the support protrusion protruding therefrom.

Here, the front body includes a mounting frame formed at an edge of the through hole so as to be stably mounted and supported on the heat dissipation unit; and the transmission cover includes a reflection frame put on the mounting frame while surrounding the LED unit; a transmission plate put on the reflection frame while transmitting light; and a finishing frame put on the transmission plate while surrounding an edge of the transmission plate.

Here, the front body further includes a spacing frame protruding an edge of the through hole toward the heat dissipation unit so as to connect the edge of the through hole and the mounting frame.

Here, the transmission cover further includes airtight rings to be interposed between the reflection frame and the transmission plate, and between the reflection frame and the heat dissipation unit.

Advantageous Effects

In an LED lighting fixture according to the present invention, power of LED units is increased even though the number of LED units arranged on a control board is decreased, an effect on dissipating heat from the LED units is enhanced, and a visible range of a lighting fixture is increased with improved straight propagation of light emitted from the lighting fixture.

Further, the detailed coupling structure of the control board, the heat dissipation unit and the cooling unit facilitates heat transfer among them, and enhances the effect on dissipating the heat from the LED units with the enhanced heat transfer rate.

Further, the coupling between the ventilation hole and the guide projection makes air flow in to the inside of the illumination body unit or flow out to the outside of the illumination body unit, thereby facilitating the air circulation in the illumination body unit.

Further, the circulation activator activates the non-powered circulation of the actuating fluid in the heat pipe, and enhances the effect on dissipating heat from the LED unit.

Further, the heat dissipation block improves a heat-transfer efficiency and a cooling efficiency of the heat dissipation unit, and increases close-contact with the heat pipe.

Further, the power control unit supplies constant power to the LED unit, protects the LED unit from abnormal power, and prevents the LED unit from malfunctions.

Further, the detailed structure of the illumination body unit facilitates the air circulation inside and outside the illumination body unit to thereby enhance the effect on dissipating the heat from the LED unit, and easily release the heat generated in the LED unit.

Further, the detailed coupling structure between the illumination body unit and the heat dissipation unit improves the coupling between the illumination body unit and the heat dissipation unit, prevents the heat dissipation unit from moving in the illumination body unit, and exposes the heat dissipation unit to the outside in the illumination body unit to thereby enhance the effect on dissipating the heat from the LED unit.

Further, the detailed coupling structure of the transmission cover improves the straight propagation of light emitted from the LED unit, protects the LED unit exposed to the outside, and facilitates the release of heat dissipated in the heat dissipation unit. In particular, the addition of the airtight ring prevents water penetration into the LED unit and the control board, prevents a power connection part from corrosion due to water or salt in accordance with use places, and extends life of a lighting fixture.

DESCRIPTION OF DRAWINGS

FIG. 1 is a perspective view of an LED lighting fixture according to one embodiment of the present invention.

FIG. 2 is a perspective bottom view of an LED lighting fixture according to one embodiment of the present invention.

FIG. 3 is an exploded perspective view of an LED lighting fixture according to one embodiment of the present invention.

FIG. 4 is a partial cross-section view of showing a coupled state between a heat dissipation unit and a cooling unit in an LED lighting fixture according to one embodiment of the present invention.

FIG. 5 is a partial cross-section view of showing a coupled state between a heat dissipation unit and an illumination body unit in an LED lighting fixture according to one embodiment of the present invention.

FIG. 6 is a partial cross-section view of a coupled state of a transmission cover in an LED lighting fixture according to one embodiment of the present invention.

BEST MODE

Below, one embodiment of an LED lighting fixture according to the present invention will be described with reference to accompanying drawings. In this case, the present invention is not limited to or restricted by the embodiment. Further, in describing the present invention, detailed descriptions about publicly known functions or elements may be omitted to make the gist of the present invention clear.

FIG. 1 is a perspective view of an LED lighting fixture according to one embodiment of the present invention, FIG. 2 is a perspective bottom view of an LED lighting fixture according to one embodiment of the present invention, FIG. 3 is an exploded perspective view of an LED lighting fixture according to one embodiment of the present invention, FIG. 4 is a partial cross-section view of showing a coupled state between a heat dissipation unit and a cooling unit in an LED lighting fixture according to one embodiment of the present invention, FIG. 5 is a partial cross-section view of showing a coupled state between a heat dissipation unit and an illumination body unit in an LED lighting fixture according to one embodiment of the present invention, and FIG. 6 is a partial cross-section view of a coupled state of a transmission cover in an LED lighting fixture according to one embodiment of the present invention.

Referring to FIGS. 1 to 6, the LED lighting fixture according to one embodiment of the present invention includes an LED unit 10, a control board 20, a heat dissipation unit 30, a cooling unit 40, and an illumination body unit 50.

The LED unit 10 receives electric power and emits light. The LED unit 10 may have various types to emit light. For example, the LED unit 10 may include an LED element for emitting light by supplied power, and a protective lens for surrounding and protecting the LED element and adjusting the emitted light.

The control board 20 includes a plurality of LED units 10 arranged thereon. The control board 20 applies electric power to the plurality of LED units 10. The control board 20 includes a metallic material to prevent deformation by heat generated in the LED unit 10 and improve a heat transfer rate so that the heat generated in the LED unit 10 can be easily transferred to the heat dissipation unit 30.

The heat dissipation unit 30 is coupled to the control board 20 and transfers the heat generated in the control board 20. The heat dissipation unit 30 may include a support groove 301 recessed for coupling with a support protrusion 505 provided in the illumination body unit 50. Further, the heat dissipation unit 30 may include a connection groove 302 recessed to receive an electric wire for connecting a power line to the control board 20 therein. Since a direct current (DC) power is used as the electric power supplied to the LED unit 10, the connection groove 302 recessed on the heat dissipation unit 30 may be formed as a single one or a pair of grooves spaced apart from each other. Further, the heat dissipation unit 30 may be formed with a bracket connector 303. The bracket connector 303 connects with a separate bracket (not shown) by a fastening member (not shown). The bracket connector 303 may be provided in the heat dissipation unit 30 exposed to the outside in accordance with an exposure groove 504 (to be described later). Although it is not illustrated, the bracket connector 303 may be provided in a front body 51 or a rear body 52 of the illumination body unit 50 (to be described later). The bracket connector 303 allows the LED lighting fixture according to one embodiment of the present invention to be rotatable. In this case, a cooling fin 43 of the cooling unit 40 (to be described later) is relatively high to improve a heat dissipation effect of the heat dissipation unit 30.

The heat dissipation unit 30 includes a heat dissipation plate 31, a mounting slit groove 32, a heat dissipation fin 33.

The heat dissipation plate 31 is in close-contact with the control board 20. The heat dissipation plate 31 is shaped like a flat plate to improve the close-contact with the control board 20. Thus, the control board 20 can be in close-contact with a first surface of the heat dissipation plate 31.

The mounting slit groove 32 is provided in plural. The plurality of mounting slit grooves 32 are provided on the heat dissipation plate 31 and spaced apart from each other so that the cooling unit 40 can be stably mounted thereto. Thus, a heat pipe 41 (to be described later) can be inserted in and stably mounted to the mounting slit groove 32. The mounting slit groove 32 may be provided on a second surface of the heat dissipation plate 31. For example, the mounting slit groove 32 may be recessed on the second surface of the heat dissipation plate 31. Alternatively, the mounting slit groove 32 may be recessed on a heat dissipation block 311 protruding from the second surface of the heat dissipation plate 31. Here, the heat dissipation block 311 may be provided to enhance the close contact with the heat pipe 41 (to be described later) and improve a heat transfer rate between the heat dissipation unit 30 and the cooling unit 40.

The heat dissipation fin 33 is provided in plural. The plurality of heat dissipation fins 33 are spaced apart from each other and protrude from the second surface of the heat dissipation plate 31. The heat dissipation fin 33 may protrude from the heat dissipation plate 31 in various forms such as needles or plates.

Then, the mounting slit groove 32 and the heat dissipation fin 33 are alternately arranged on the second surface of the heat dissipation plate 31 to thereby improve the heat dissipation effect.

The cooling unit 40 is coupled to the heat dissipation unit 30. The cooling unit 40 cools the heat dissipation unit 30 by non-powered circulation of an actuating fluid filled therein. Here, the actuating fluid is a mixture between a medium including methyl alcohol and powder having a characteristic of infrared radiation. Thus, the heat pipe 41 (to be described later) does not have to include a wick, and facilitate the non-powered circulation of the actuating fluid.

The cooling unit 40 includes the heat pipe 41, amounting holder 42, and the cooling fin 43.

The heat pipe 41 is filled with the actuating fluid. The heat pipe 41 partially protrudes from one side of the heat dissipation plate 31. The heat pipe 41 is in close contact with the mounting slit groove 32.

The mounting holder 42 mounts the heat pipe 41 to the heat dissipation plate 31. The mounting holder 42 is provided as a bracket for surrounding the heat pipe 41, and holds the heat pipe 41 mounted to the heat dissipation plate 31 by screw coupling using a fastening member (not shown) or hook coupling. The mounting holder 42 is not limited to this shape, but may have various shapes for mounting the heat pipe 41 to the heat dissipation plate 31. The mounting holder 42 may include a plurality of auxiliary cooling fins 44 protruding therefrom to enhance the heat dissipation effect.

The cooling fin 43 is provided in plural. The plurality of cooling fins 43 are protruding from a part of the heat pipe 41 protruding from one side of the heat dissipation plate 31. Like the heat dissipation fin 33, the cooling fin 43 may protrude from a part of the heat pipe 41 in various forms such as needles, plates, etc.

Here, the heat pipe 41 is relatively high at a side of the cooling fin 43 so as to facilitate the non-powered circulation of the actuating fluid, improves contact with air through a ventilation hole 502 and a guide projection 506, and prevents the heat dissipation unit 30, the control board 20, and the LED unit 10 from overheating.

The illumination body unit 50 supports the heat dissipation unit 30 and exposes the LED unit 10. The illumination body unit 50 is formed as a hollow housing, and is internally provided with the heat dissipation unit 30 and the cooling unit 40. Further, the illumination body unit 50 may be internally provided with a power control unit 60 (to be described later).

Thus, the illumination body unit 50 includes a through hole 501, the ventilation hole 502, and an accommodating space 503.

The through hole 501 is formed as a single one in the illumination body unit 50 so that the LED unit 10 can be exposed there through. In this case, the illumination body unit 50 may include a transmission cover 54 to open and close the through hole 501.

The ventilation hole 502 is provided in plural. The plurality of ventilation holes 502 are formed in the illumination body unit 50 and allow air to pass there through. In this case, the guide projection 506 may protrude from one side of the ventilation hole 502 and circulate air. The guide projection 506 may protrude from the edge of the ventilation hole 502. With the guide projection 506, not only external air stably flows in to the inside of the illumination body unit 50, but also internal air of the illumination body unit 50 stably flows out to the outside, thereby facilitating air circulation. Here, the cooling fin 43 is relatively high to enhance the heat dissipation effects of the heat dissipation unit 30.

The accommodating space 503 forms a space in which the heat dissipation unit 30 and the cooling unit 40 are accommodated.

Further, the illumination body unit 50 may be provided with the exposure groove 504 through which a part of the heat dissipation unit 30 is exposed. The heat dissipation unit 30 is supported in the exposure groove 504. Although the heat dissipation unit 30 is partially exposed through the exposure groove 504, the illumination body unit 50 prevents the heat dissipation unit 30 from moving.

Further, the illumination body unit 50 may be formed with a power mounting space 507 to which the power control unit 60 (to be described later) is mounted. Alternatively, the illumination body unit 50 may include a power heat dissipation body 53, and the power heat dissipation body 53 may be formed with the power mounting space 507 communicating with the accommodating space 503. The power heat dissipation body 53 may be formed with the ventilation hole 502.

Further, the illumination body unit 50 may include a circulation activator 508 which makes the heat pipe 41 be relatively elevated at the side of the cooling fin 43. For example, the circulation activator 508 may be provided in the form of a projection protruding from the illumination body unit 50. Here, there are no limits to the circulation activator 508. The circulation activator 508 may have various shapes as long as it can make the heat pipe be relatively high at the side of the cooling fin.

Further, the illumination body unit 50 may be formed with a spacing pin to support and space the heat dissipation unit 30 and the cooling unit 40. The illumination body unit 50 includes the front body 51, the rear body 52, the accommodating space 503, and the transmission cover 54, and further includes the power heat dissipation body 53.

The front body 51 includes the through hole 501 and the ventilation hole 502. Along with the ventilation hole 502, the guide projection 506 may protrude from the front body 51. The front body 51 is supported on the heat dissipation unit 30.

The rear body 52 includes the ventilation hole 502 and is supported on the heat dissipation unit 30. The rear body 52 couples with the front body 51. Here, the edges of the front body 51 and the rear body 52 have various shapes for connection such as coupling between a projection and a groove, engagement between a projection and a projection, hook coupling, etc., thereby connecting the edges of the illumination body unit 50. Further, the front body 51 and the rear body 52 may be screw-coupled using a fastening member (not shown) or hook-coupled to thereby enhance the coupling between them.

Thus, it is possible to make an outer appearance beautiful and smooth, prevent a gap between the front body 51 and the rear body 52, and inhibit or prevent movement between the front body 51 and the rear body 52.

In this case, the heat dissipation unit 30 is formed with the support groove 301, and each of the front body 51 and the rear body 52 is formed with the support protrusion 505 to be inserted in the support groove 301. Thus, when the heat dissipation unit 30 is supported on each of the front body 51 and the rear body 52, the heat dissipation unit 30 is prevented from moving between the front body 51 and the rear body 52.

Further, at least one of the front body 51 and the rear body 52 may be formed with the exposure groove 504 in which the heat dissipation unit 30 is inserted and supported while the heat dissipation unit 30 is exposed. The exposure groove 504 is formed with the support protrusion 505 to thereby expose a part of the heat dissipation unit 30 to air and make the front body 51, the rear body 52 and the heat dissipation unit 30 be stably coupled.

The accommodating space 503 accommodates the heat dissipation unit 30 and the cooling unit 40 therein. The accommodating space 503 may be formed in at least one of the front body 51 and the rear body 52. Further, the spacing pin may protrude from at least one of the front body 51 and the rear body 52 and make the heat dissipation unit 30 be spaced from and supported on the illumination body unit 50.

The transmission cover 54 opens and closes the through hole 501.

In this case, the front body 51 may be provided with a mounting frame 512 stably mounted and supported on the heat dissipation unit 30. The mounting frame 512 is formed at the edge of the through hole 501. In this case, the front body 51 may further include a spacing frame 511 for connecting the edge of the through hole 501 and the mounting frame 512. The spacing frame 511 protrudes from the edge of the through hole 501 toward the heat dissipation unit 30. With the spacing frame 511, the front body 51 is spaced apart from the heat dissipation unit 30, the air circulation is facilitated through the ventilation hole 502, and surface contact between the front body 51 and the heat dissipation unit 30 is restricted to thereby prevent the front body 51 from being deformed.

Here, the transmission cover 54 may include a reflection frame 541, a transmission plate 542, and a finishing frame 543, and further include a airtight ring 544.

The reflection frame 541 is stacked on the mounting frame 512 while surrounding the LED unit 10. The reflection frame 541 may have a ring shape, through which the LED unit 10 is exposed, by a single ring or by coupling a plurality of rings. The reflection frame 541 is formed to have a wide top and a narrow bottom, i.e. a small lower end portion and a large upper end portion with respect to a traveling direction of light, so that light can propagate without blockage. The inner edge of the reflection frame 541 may be supported on the edge of the control board 20 as shown in FIG. 6.

The transmission plate 542 is stacked on the reflection frame 541 and transmits light. The transmission plate 542 may be made of various materials and put on the reflection frame 541.

The finishing frame 543 is put on the transmission plate 542 while surrounding the edge of the transmission plate 542. Like the reflection frame 541, the finishing frame 543 may have a ring shape, through which the LED unit 10 is exposed, by a single ring or by coupling a plurality of rings. The finishing frame 543 has only to be put on the transmission plate 542, and has a "L"-shaped cross-section as shown in FIG. 6, thereby surrounding the outer circumference of the reflection frame 541 while being put on the transmission plate 542.

The heat dissipation unit 30, the mounting frame 512, the reflection frame 541, the transmission plate 542 and the finishing frame 543 may be detachably coupled by screw-coupling using a fastening member (not shown) or by hook-coupling.

The airtight ring 544 is interposed between the reflection frame 541 and the transmission plate 542. Further, the airtight ring 544 is interposed between the reflection frame 541 and the heat dissipation unit 30. As shown in FIG. 6, the airtight ring 544 makes a hermetical seal between the reflection frame 541 and the transmission plate 542, and a hermetical seal between the reflection frame 541 and the heat dissipation unit 30, thereby keeping the LED unit 10 and the control board 20 airtight without air penetration. Here, the reflection frame 541 may be formed with an airtight groove in which the airtight ring 544 is inserted and supported. Although it is not illustrated, the airtight groove may be recessed on the transmission plate 542 or the heat dissipation plate 31.

The power heat dissipation body 53 is provided in the rear body 52. The power mounting space 507 communicates with the accommodating space 503, and the power control unit 60 is in contact with and supported on the heat dissipation unit 30 and the cooling unit 40, thereby dissipating heat generated in the power control unit 60.

The LED lighting fixture according to one embodiment of the present invention may further include the power control unit 60. The power control unit 60 controls power to be applied to the control board 20. The power control unit 60 may convert input alternating current (AC) power into DC power so that the DC power can be supplied to the LED unit 10. Further, the power control unit 60 may keep the DC power constantly applied to the control board 20 and thus stabilize the DC power. To have an improved effect on dissipating the heat of the power control unit 60, at least one heat transfer supporter 61 is interposed between the heat dissipation unit 30 and the power control unit 60.

In the foregoing LED lighting fixture, power of the LED units 10 is increased even though the number of LED units 10 arranged on the control board 20 is decreased, an effect on dissipating heat from the LED units 10 is enhanced, and a visible range of a lighting fixture is increased with improved straight propagation of light emitted from the lighting fixture.

Further, when the foregoing LED lighting fixture is applied to a scenery lighting or the like and emits light upward from the bottom, the cooling fin 43 is arranged to be relatively high, thereby facilitating the non-powered circulation of the actuating fluid filled in the heat pipe 41 and maximizing an effect on dissipating heat from the heat dissipation unit 30.

Further, the detailed coupling structure of the control board 20, the heat dissipation unit 30 and the cooling unit 40 facilitates heat transfer among them, and enhances the effect on dissipating the heat from the LED units 10 with the enhanced heat transfer rate. Further, the coupling between the ventilation hole 502 and the guide projection 506 makes air flow in to the inside of the illumination body unit 50 or flow out to the outside of the illumination body unit 50, thereby facilitating the air circulation in the illumination body unit 50. Further, the circulation activator 508 activates the non-powered circulation of the actuating fluid in the heat pipe 41, and enhances the effect on dissipating heat from the LED unit 10. Further, the heat dissipation block 311 improves a heat-transfer efficiency and a cooling efficiency of the heat dissipation unit 30, and increases close-contact with the heat pipe 41.

Further, the power control unit 60 supplies constant power to the LED unit 10, protects the LED unit 10 from abnormal power, and prevents the LED unit 10 from malfunctions.

Further, the detailed structure of the illumination body unit 50 facilitates the air circulation inside and outside the illumination body unit 50 to thereby enhance the effect on dissipating the heat from the LED unit 10, and easily release the heat generated in the LED unit 10. Further, the detailed coupling structure between the illumination body unit 50 and the heat dissipation unit 30 improves the coupling between the illumination body unit 50 and the heat dissipation unit 30, prevents the heat dissipation unit 30 from moving in the illumination body unit 50, and exposes the heat dissipation unit 30 to the outside in the illumination body unit 50 to thereby enhance the effect on dissipating the heat from the LED unit.

Further, the detailed coupling structure of the transmission cover 54 improves the straight propagation of light emitted from the LED unit 10, protects the LED unit 10 exposed to the outside, and facilitates the release of heat dissipated in the heat dissipation unit 30. In particular, the addition of the airtight ring 544 prevents water penetration into the LED unit 10 and the control board 20, prevents a power connection part from corrosion due to water or salt in accordance with use places, and extends life of a lighting fixture.

Although the preferred embodiments of the present invention have been described with reference to accompanying drawings, it will be appreciated for those skilled in the art that various modifications and changed can be made without departing from the scope of the present invention defined in the appended claims.

INDUSTRIAL APPLICABILITY

An LED lighting fixture according to the present invention can be applied to indoor or outdoor lighting, and replace an incandescent lamp, a fluorescent lamp, and the like.

The invention claimed is:

1. An LED lighting fixture comprising:

an LED unit which emits light;

a control board on which a plurality of LED units is arranged and which applies electric power to the LED units;

a heat dissipation unit which couples with the control board so that heat generated in the control board can be transferred thereto;

a cooling unit which is coupled to the heat dissipation unit and cools the heat dissipation unit by non-powered circulation of an actuating fluid filled therein; and a housing unit which is internally provided with the heat dissipation unit and the cooling unit and supports the heat dissipation unit while exposing the LED unit, wherein the heat dissipation unit comprises a heat dissipation plate with which the control board is in close contact;

a plurality of mounting slit grooves which are provided in the heat dissipation plate and spaced apart from each other to mount the cooling unit thereto; and a plurality of heat dissipation fins which protrude from the heat dissipation plate, and wherein the cooling unit comprises a heat pipe which is filled with the actuating fluid, and is in close contact with and supported by the mounting slit groove so as to partially protrude from one side of the heat dissipation plate;

a mounting holder which mounts the heat pipe to the heat dissipation plate; and a plurality of cooling fins which protrude from a part of the heat pipe protruding from one side of the heat dissipation plate.

2. The LED lighting fixture according to claim 1, wherein the housing unit comprises a plurality of ventilation holes through which air passes, and a guide projection protruding from one side of the ventilation hole.

3. The LED lighting fixture according to claim 1, wherein the housing unit comprises a circulation activator which makes the heat pipe be relatively elevated at a side of the cooling fin.

4. The LED lighting fixture according to claim 1, wherein the mounting slit groove is recessed on a heat dissipation block protruding from the heat dissipation plate.

5. The LED lighting fixture according to claim 1, further comprising a power control unit which controls electric power applied to the control board.

6. The LED lighting fixture according to claim 1, wherein the housing unit comprises a front body which comprises a through hole for exposing the LED unit and a plurality of ventilation holes for passing air, and is supported on the heat dissipation unit;

a rear body which comprises the ventilation hole, is supported on the heat dissipation unit, and couples with the front body;

an accommodating space which is formed in at least one of the front body and the rear body to accommodate the heat dissipation unit and the cooling unit; and a transmission cover which opens and closes the through hole.

7. The LED lighting fixture according to claim 6, wherein the heat dissipation unit is formed with a support groove recessed thereon, and the front body and the rear body are respectively formed with support protrusions protruding therefrom to be inserted in the support groove.

8. The LED lighting fixture according to claim 7, wherein at least one of the front body and the rear body comprises an exposure groove in which the heat dissipation unit is inserted and supported, and the exposure groove comprises the support protrusion protruding therefrom.

9. The LED lighting fixture according to claim 6, wherein the front body comprises a mounting frame formed at an edge of the through hole so as to be stably mounted and supported on the heat dissipation unit; and the transmission cover comprises a reflection frame put on the mounting frame while surrounding the LED unit;

a transmission plate put on the reflection frame while transmitting light; and a finishing frame put on the transmission plate while surrounding an edge of the transmission plate.

10. The LED lighting fixture according to claim 9, wherein the front body further comprises a spacing frame protruding an edge of the through hole toward the heat dissipation unit so as to connect the edge of the through hole and the mounting frame.

11. The LED lighting fixture according to claim 9, wherein the transmission cover further comprises airtight rings to be interposed between the reflection frame and the transmission plate, and between the reflection frame and the heat dissipation unit.

* * * * *